US006755103B2

(12) United States Patent
Morehead

(10) Patent No.: US 6,755,103 B2
(45) Date of Patent: Jun. 29, 2004

(54) BALL-LOCK INSERT ASSEMBLIES

(75) Inventor: John H. Morehead, White Bear Lake, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 10/071,888

(22) Filed: Feb. 8, 2002

(65) Prior Publication Data

US 2003/0154836 A1 Aug. 21, 2003

(51) Int. Cl.[7] ..... B26D 1/00

(52) U.S. Cl. ..... 83/13; 83/140; 83/698.31; 83/698.91

(58) Field of Search ..... 83/698.31, 698.91, 83/140, 134, 13; 279/77, 79, 22, 23.1, 30

(56) References Cited

U.S. PATENT DOCUMENTS

| | | | | | |
|---|---|---|---|---|---|
| 1,860,998 | A | | 5/1932 | Drazick | |
| 1,910,275 | A | * | 5/1933 | Alden | 279/77 |
| 1,910,296 | A | * | 5/1933 | King | 279/77 |
| 1,938,440 | A | | 12/1933 | Richard | |
| 2,160,676 | A | * | 5/1939 | Richard | 83/140 |
| 2,166,559 | A | * | 7/1939 | Richard | 279/30 |
| 2,662,773 | A | | 12/1953 | Parsons | |
| 3,176,998 | A | * | 4/1965 | Parker | 279/76 |
| 3,589,226 | A | * | 6/1971 | Shadowens, Jr. | 83/143 |
| 3,707,303 | A | * | 12/1972 | Petri | 403/328 |
| 4,558,620 | A | * | 12/1985 | Wallis | 83/699.31 |
| 4,726,270 | A | * | 2/1988 | Lucas | 83/13 |
| 5,181,438 | A | * | 1/1993 | Wellman | 76/107.1 |
| 5,197,368 | A | | 3/1993 | Meyer et al. | 83/698 |
| 5,357,835 | A | * | 10/1994 | Moellering | 83/698.31 |

* cited by examiner

*Primary Examiner*—Allan N. Shoap
*Assistant Examiner*—Phong Nguyen
(74) *Attorney, Agent, or Firm*—Fredrikson & Byron, P.A.

(57) ABSTRACT

The invention provides a ball-lock insert assembly adapted to be mounted axially in a mount opening formed in a holder plate having a desired thickness. The ball-lock insert assembly comprises an insert body having an axis and an elongated interior recess extending at an angle relative to this axis. The elongated interior recess is configured to house a resiliently-biased engagement member. The invention also provides retainer assemblies that include ball-lock assemblies, as well as methods of producing retainer assemblies, which methods include providing ball-lock assemblies.

35 Claims, 11 Drawing Sheets

Figure 4A
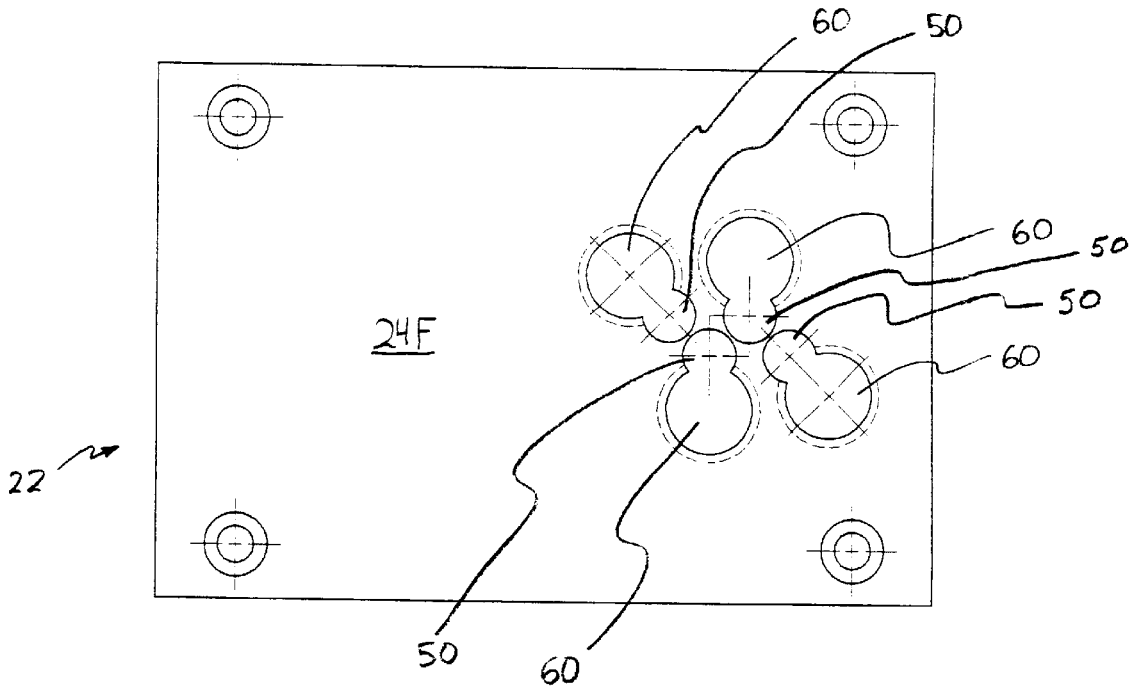
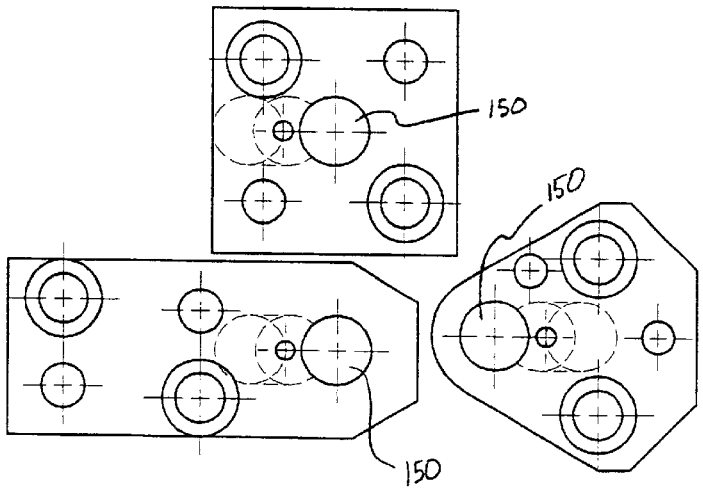
Figure 4B

Figure 5A
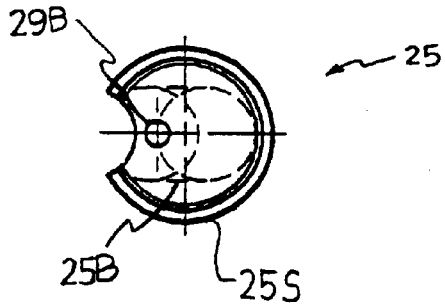
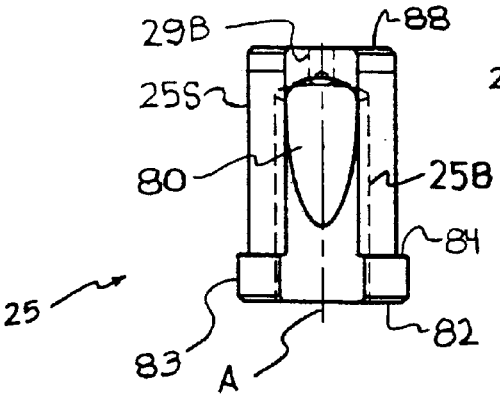
Figure 5B
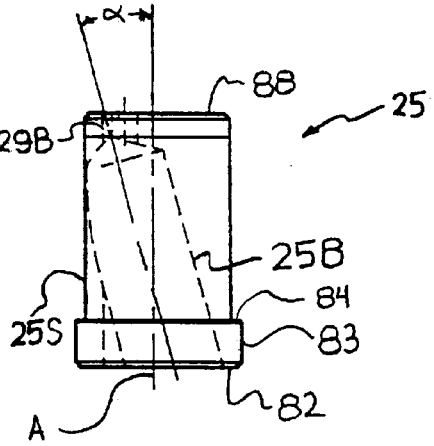
Figure 5C

Figure 6A
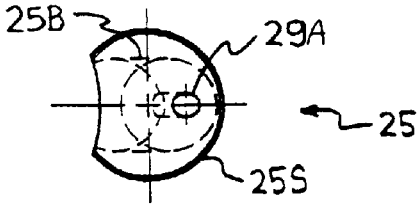
Figure 6B
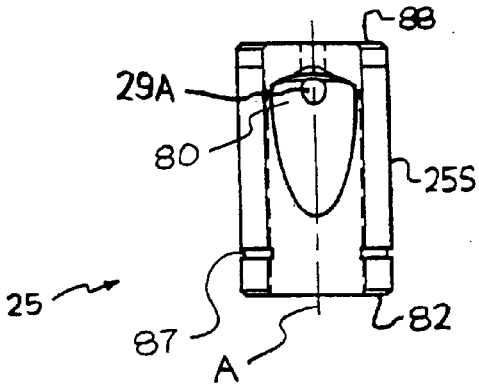
Figure 6C
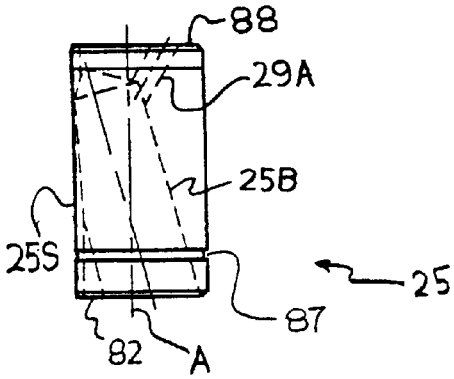
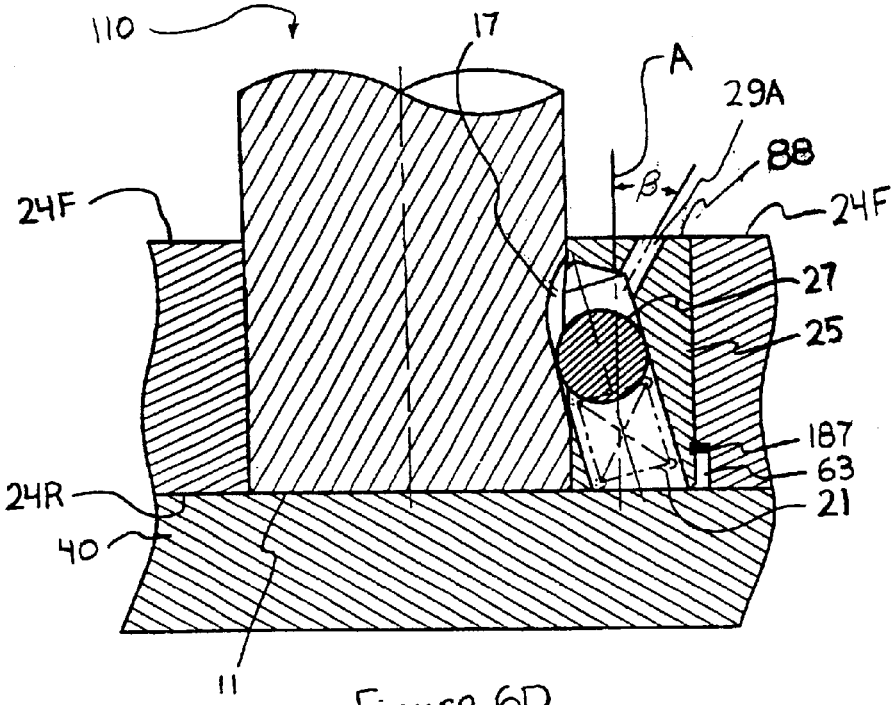
Figure 6D Figure 7A
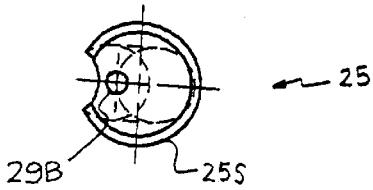
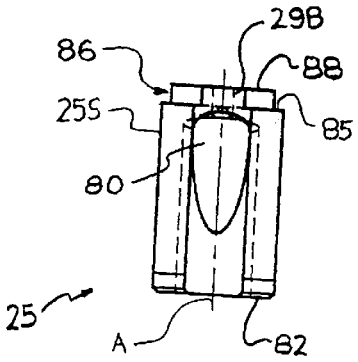
Figure 7B
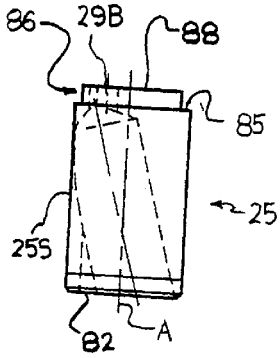
Figure 7C
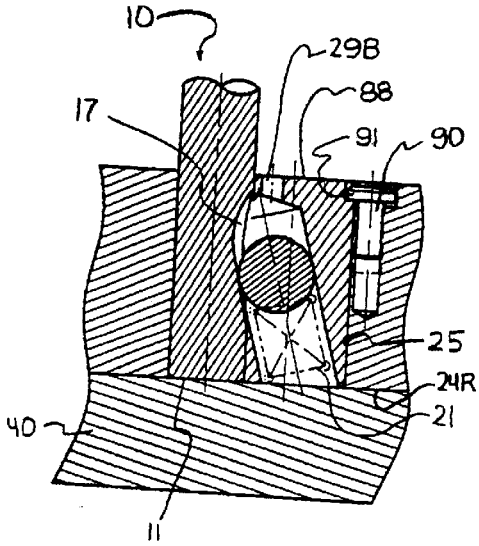
Figure 7D

BALL-LOCK INSERT ASSEMBLIES

FIELD OF THE INVENTION

The present invention relates to punch presses. More particularly, this invention relates to tool retainers for punch presses.

BACKGROUND OF THE INVENTION

Tool retainers for punch presses are well known in the art. Typically, the retainer is a metal block that carries a tool (e.g., a punch or die). The tool held by the retainer normally extends away from the retainer block toward a workpiece (e.g., a piece of sheet metal) to be punched or formed. The retainer block is usually secured to a mounting plate of the punch press. Thus, the retainer block interconnects the tool and the press, and enables the tool to be accurately positioned.

Tool retainers are preferably adapted to carry tools in a removable manner. For example, the workpiece-deforming surfaces of punches and dies wear down after repeated use. Thus, it is necessary to periodically remove such tools for sharpening. Toward this end, prior art retainers have been provided with ball locks that allow repeated removal and replacement of punches or dies. Reference is made to U.S. Pat. Nos. 2,160,676(Richard), 2,166,559(Richard), and 3,176,998(Parker). The entire contents of these patents are incorporated herein by reference.

Ball locks characteristically comprise a retainer block in which two elongated bores are formed. One of the bores is adapted to receive the shank of a punch or die. This bore typically extends from near the back wall (which is typically secured to a mounting plate of the punch press) of the retainer block to the front wall of the retainer block, where such bore opens through the front wall of the retainer block. A second bore formed in the retainer block houses a spring-biased ball. This second bore extends at an angle, relative to the axis of the shank-receiving bore, from near the back wall of the retainer block to a point of intersection with the shank-receiving bore. The second, angled bore opens into the shank-receiving bore at this intersection point.

The shank of a standard ball-lock tool characteristically has a tapered recess that can be lockingly engaged by the ball in a ball lock. When the shank is operatively positioned within the shank-receiving bore, the tapered recess on the shank is aligned with the intersection point of the angled bore and the shank-receiving bore. The spring in the angled bore urges the ball toward the tapered recess on the shank. With the shank so positioned, the spring-biased ball engages the recess on the shank, thereby securely holding the tool in position. That is, the spring causes the ball to be pushed toward, and maintained in, a position where the ball is effectively trapped between the tapered recess of the shank and the interior surface of the angled bore.

It would be advantageous to provide ball-lock insert assemblies adapted for mounting in customer-manufactured holder plates. That is, it would be desirable to provide discrete ball-lock inserts that could be removably mounted in openings formed in a holder plate. By providing inserts of this nature, customers could use their own holder plates and form in those plates openings adapted to receive the inserts. The customer could form any number of openings in any desired arrangement. This would allow the customer to readily manufacture holder plates configured to retain essentially any desired arrangement of tools.

Inserts of this nature could be used quite advantageously in a variety of devices. For example, it is anticipated that these inserts would have particular utility in "permanent" (or "continuous") punch presses. Permanent-type punch presses are well known in the art. These presses characteristically include a plurality of permanently-positioned punch stations, each adapted to perform a given punching or forming operation upon a workpiece that is conveyed sequentially from station to station. While the present invention is by no means limited to use with permanent-type punch presses, embodiments of this nature are expected to have particular advantage.

SUMMARY OF THE INVENTION

One embodiment of the present invention provides a retainer assembly for a punch press. The retainer assembly comprises a holder plate of a desired thickness. The holder plate has therein formed first and second elongated openings, each extending entirely through the thickness of the holder plate. The first and second openings are adjacent and generally parallel to each other. The first opening is configured to receive the shank of a tool. The retainer assembly includes a removable ball-lock insert assembly comprising an insert body. The insert body has an axis and an elongated interior recess extending at an angle relative to the axis of the insert body. The elongated interior recess is configured to house a resiliently-biased engagement member. The insert body is configured to be received axially within the second opening in an operative position wherein one end region of the elongated interior recess opens through a sidewall of the insert body into the first opening in the holder plate.

In another embodiment, the invention provides a retainer assembly for a punch press. The retainer assembly comprises a holder plate having a first, workpiece-facing surface and second, rear surface. These first and second surfaces are generally opposed. The holder plate has therein formed first and second elongated openings each opening through the workpiece-facing surface of the holder plate. These first and second openings are adjacent and generally parallel to each other. The first opening is configured to receive the shank of a tool. The retainer assembly includes a ball-lock insert assembly comprising an insert body having a height that is substantially equal to the thickness of the holder plate. The insert body has an axis and an elongated interior recess extending at an angle relative to the axis of the insert body. The elongated interior recess houses a resiliently-biased engagement member. The insert body is removably mounted within the second opening (of the holder plate) in an operative position wherein one end region of the insert's elongated interior recess opens through a sidewall of the insert body into the first opening in the holder plate.

In still another embodiment of the invention, there is provided a ball-lock insert assembly adapted to be removably mounted axially in a mount opening formed in a holder plate of a desired thickness. The ball-lock insert assembly comprises an insert body having an axis and an elongated interior recess extending at an angle relative to the axis of the insert body. The elongated interior recess houses a resiliently-biased engagement member. The insert body has at least one catch surface configured for securing the insert body within the mount opening in the holder plate.

In a further embodiment of the invention, there is provided a method of producing a retainer assembly. The method includes providing a ball-lock insert assembly comprising an insert body having an axis and an elongated interior recess extending at an angle relative to the axis of the insert body. The elongated interior recess is configured to house a resiliently-biased engagement member. There is provided a holder plate having a front, workpiece-facing surface and a rear surface, wherein the front and rear surfaces of the holder plate are generally opposed. There is formed in the holder plate an elongated mount opening that opens through the front, workpiece-facing surface of the holder plate. This elongated mount opening is configured to axially receive the insert body.

BRIEF DESCRIPTION OF THE DRAWINGS

FIG. 4A is a top view of a holder plate in accordance with one embodiment of the invention;

FIG. 4B is a top view of three prior art retainer blocks;

FIG. 5A is a top view of a ball-lock insert in accordance with one embodiment of the invention;

FIG. 5B is a side view of the ball-lock insert of FIG. 5A;

FIG. 5C is another side view of the ball-lock insert of FIG. 5A;

FIG. 6A is a top view of a ball-lock insert in accordance with another embodiment of the invention;

FIG. 6B is a side view of the ball-lock insert of FIG. 6A;

FIG. 6C is another side view of the ball-lock insert of FIG. 6A;

FIG. 6D is a broken-away cross-sectional side view of the ball-lock insert of FIG. 6A in assembly within a holder plate in accordance with one embodiment of the invention;

FIG. 7A is a top view of a ball-lock insert in accordance with still another embodiment of the invention;

FIG. 7B is a side view of the ball-lock insert of FIG. 7A;

FIG. 7C is another side view of the ball-lock insert of FIG. 7A;

FIG. 7D is a broken-away cross-sectional side view of the ball-lock insert of FIG. 7A in assembly within a holder plate in accordance with one embodiment of the invention;

DETAILED DESCRIPTION OF PREFERRED EMBODIMENTS

Figure 1:
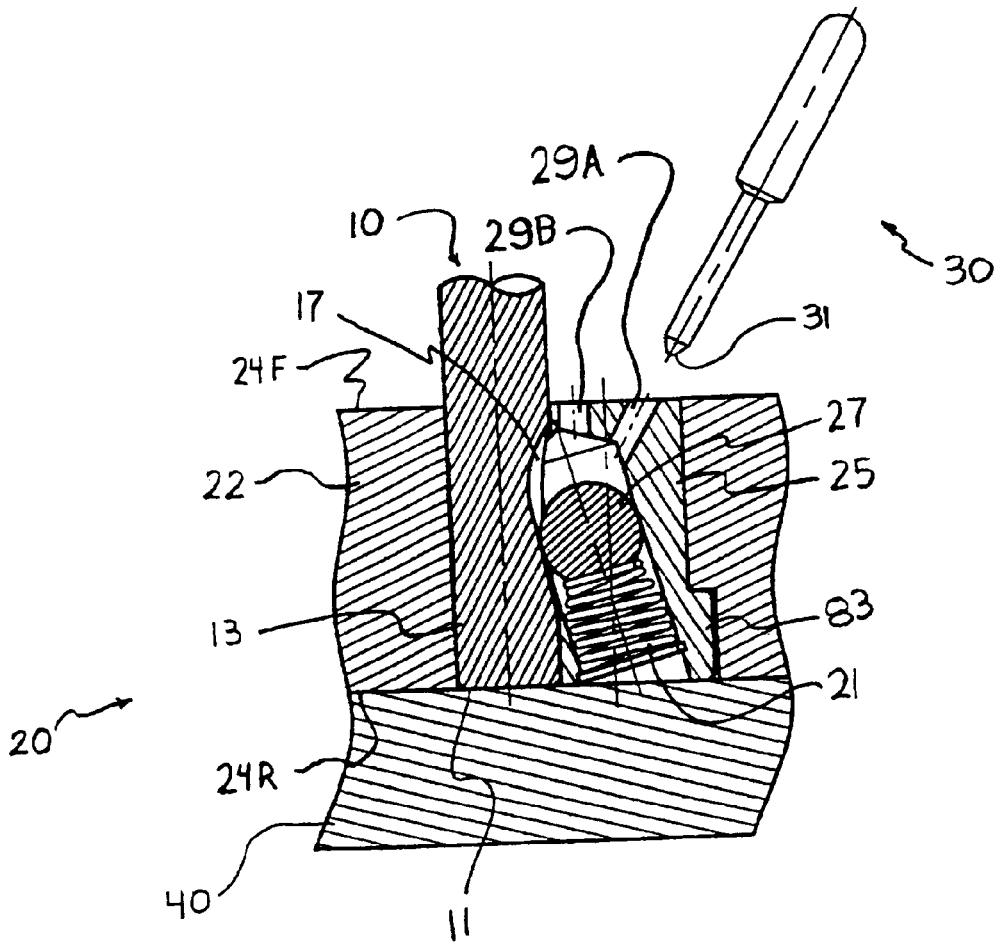
FIG. 1 is a broken-away cross-sectional side view of a tool held in a holder plate by a ball-lock insert assembly in accordance with one embodiment of the present invention.

The following detailed description is to be read with reference to the drawings, in which like elements in different drawings have been given like reference numerals. The drawings, which are not necessarily to scale, depict selected embodiments and are not intended to limit the scope of the invention.

FIG. 1 illustrates one embodiment of the present invention, wherein there is provided a tool 10, a retainer assembly 20, and a removal tool 30. The retainer assembly 20 is adapted to removably retain the tool 10 in its operative position (depicted in FIG. 1). The tool 10 may be a punch, a die, or the like. In its operative position, the tool 10 is adapted to perform a punching or forming operation upon a workpiece (e.g., a piece of sheet metal). Skilled artisans are quite familiar with the configuration of complimentary punches and dies, as well as with the proper placement and machining of work-pieces therebetween.

Figure 2:
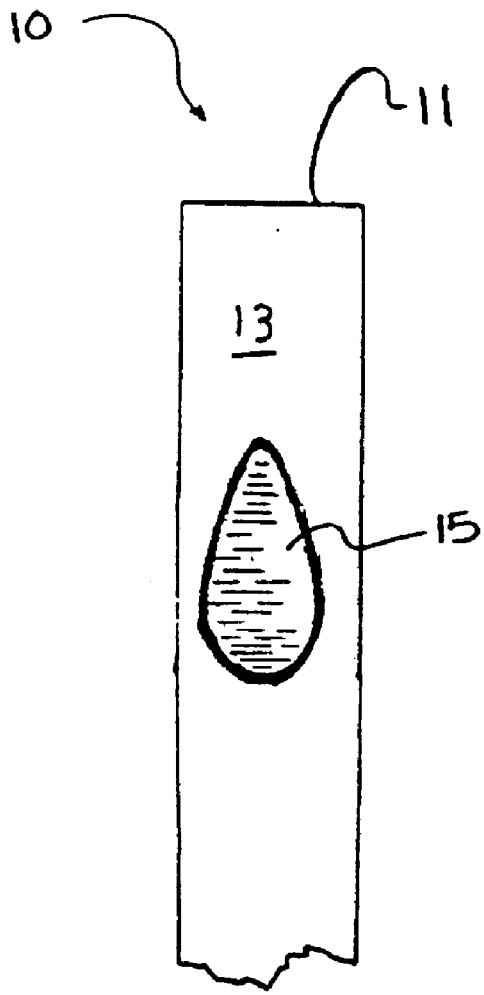
FIG. 2 is a side view of the tapered recess on the shank of a tool that is adapted for use with the ball-lock insert assembly of the invention.

The retainer assembly 20 includes a holder plate 22 to which the tool 10 can be mounted, as when the tool 10 is in the operative position depicted in FIG. 1. In this position, the holder plate 22 is equipped with a ball-lock insert assembly 25 that lockingly embraces the operatively-positioned tool 10. The ball-lock insert assembly 25 houses a resiliently-biased engagement member 27 that is urged into engagement with the shank of the tool 10. As is perhaps best appreciated with reference to FIG. 2, the shank 13 of the tool 10 has a tapered recess 17 (bounded by a depressed surface 15) that can be engaged by the engagement member 27 of the ball-lock insert assembly 25.

Thus, when the tool 10 is in its operative position, the resiliently-biased engagement member 27 engages and cooperates with the tapered recess 15 on the shank 13, so as to lock the tool 10 to the holder plate 22. This assures that the tool 10 is retained securely and accurately in its proper position during operation. When it is desired to remove the tool 10 (e.g., for sharpening or replacement), a removal tool 30 can be used to unlock the tool 10. As described below, this moves the engagement member 27 out of engagement with the shank 13 of the tool 10, allowing the tool 10 to be removed from the holder plate 22. Once removed, the tool 10 may be discarded, sharpened, or replaced, as desired.

Figure 3A:
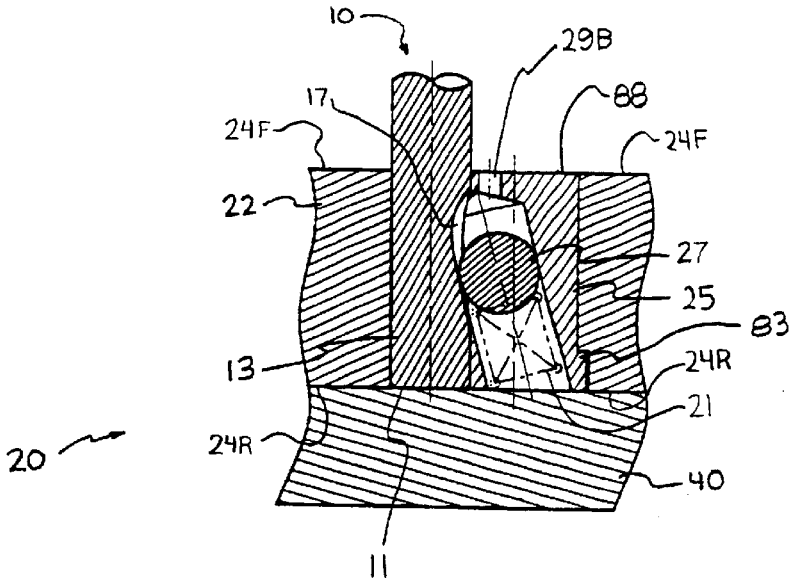
FIG. 3A is a broken-away cross-sectional side view of a tool held in a holder plate by a ball-lock insert assembly in accordance with a further embodiment of the invention.
Figure 3B:
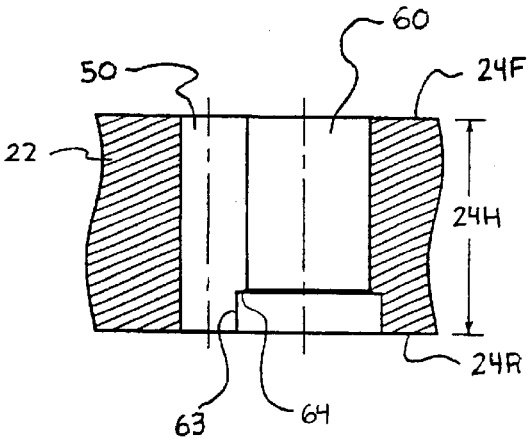
FIG. 3B is a broken-away cross-sectional side view of the holder plate of FIG. 3A depicted with both the tool and ball-lock insert assembly removed.
Figure 3C:
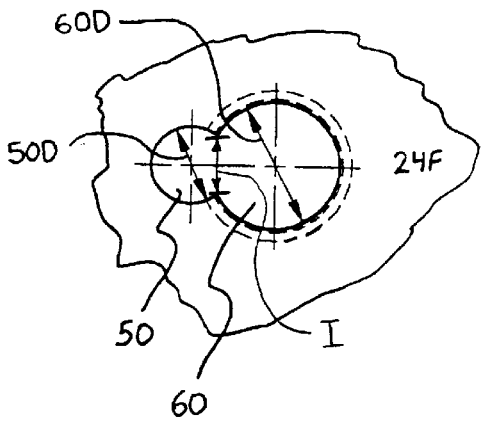
FIG. 3C is a top view of the holder plate of FIG. 3A depicted with both the tool and ball-lock insert assembly removed.

The construction of the retainer assembly 20 is perhaps best appreciated with reference to FIGS. 3A–3C. As noted above, the assembly 20 includes a holder plate 22 to which the tool 10 can be mounted. If so desired, the holder plate 22 can be provided by the customer. That is, customers may simply obtain their own holder plates and manufacture them to accommodate a desired number and arrangement of ball-lock insert assemblies 25. For example, customers could use their own holder plates and form in those plates mount openings (described below) adapted to receive the ball-lock inserts of the invention. As noted above, the customer could form any number of openings in any desired arrangement. This would allow the customer to conveniently manufacture holder plates configured to retain essentially any desired arrangement of tools.

This is perhaps best understood with reference to FIG. 4A, wherein there is illustrated a holder plate in accordance with one embodiment of the invention. The holder plate 22 of FIG. 4A is adapted to receive up to four ball-lock insert assemblies (not shown). That is, four mount openings 60, each with an adjacent shank-receiving opening 50, have been formed in the holder plate 22. The number and positioning of the mount openings 60 can, of course, be varied depending on the intended punching or forming operation.

Thus, it can be appreciated that the embodiment of FIG. 4A provides a single holder plate 22 that is configured to receive a plurality of ball-lock insert assemblies (not shown). This is contrary to prior art retainer blocks of the nature shown in FIG. 4B, as these prior art blocks are provided only with a single ball lock. It can also be appreciated that the invention facilitates positioning multiple ball locks more closely together than would be possible by mounting multiple retainer blocks adjacent one another upon a punch press. For example, four tools could be mounted more closely together in the shank-receiving openings 50 of FIG. 4A than could three tools in the openings 150 of FIG. 4B.

Thus, one embodiment of the invention provides a holder plate 22 having more than one (i.e., a plurality) mount opening 60 formed therein. In this embodiment, each mount opening 60 is configured to receive a ball-lock insert assembly 25 of the nature described herein. One aspect of the invention provides a method wherein a single holder plate 22 is provided, and a plurality of mount openings 60 (each adapted to receive a ball-lock insert assembly) are formed in the holder plate 22. In this embodiment, a shank-receiving opening 50 is also formed adjacent each mount opening 60, as described below.

With reference to FIGS. 3A–3C, the illustrated holder plate 22 can be seen to have generally-opposed front 24F and rear 24R surfaces (or "faces"). The holder plate 22 can be chosen to have any desired thickness. As can be appreciated by referring to the drawings, the front face 24F of holder plate 22 is a workpiece-facing surface. The front 24F and rear 24R faces of the illustrated holder plate 22 are planar. While this is not required, it is preferable that at least the rear face 24R be generally planar, as this face 24R is commonly carried against a planar backing plate 40.

In the embodiment of FIG. 3A, the retainer assembly 20 includes a backing plate 40 against which the rear face 24R of the holder plate 22 is carried. Preferably, the holder plate 22 is removably fastened to the backing plate 40. Any desired removable fasteners can be used to attach the holder plate 22 to the backing plate 40. For example, a number of exteriorly-threaded screw, bolts, or the like may be extended from the holder plate 22 into corresponding interiorly-threaded bores in the backing plate 40.

It is less preferred to permanently attach the holder plate 22 to the backing plate 40. However, this is an option that may be desirable in some cases. For example, this may be preferred in cases where the ball-lock insert assembly 25 is inserted and removed through the front face 24F of the holder plate 22 (as would be possible in the embodiments of FIGS. 7 and 8), rather than through the rear face 24R of the holder plate 22.

The holder plate 22 and the backing plate 40 are typically formed of a metal or metal alloy, such as steel (e.g., high alloy-soft, high alloy-Rc 54–58, etc.), or another rigid, mechanically-durable material. The selection of suitable materials for the holder plate 22, backing plate 40, and other components of the retainer assembly 20 will be well within the purview of those skilled in the art.

As is perhaps best appreciated with reference to FIG. 3C, the holder plate 22 has therein formed first 50 and second 60 openings that are adjacent and generally parallel to each other. As noted above, these openings are referred to respectively as the "shank-receiving opening" 50 and the "mount opening" 60. In the embodiment of FIG. 3C, each of these openings 50, 60 has a circular cross section. However, it will be appreciated that one or both of these openings 50, 60 may have a non-circular cross section (e.g., square, rectangular, etc.). One exemplary embodiment of this nature is illustrated in FIG. 11. Many variations of this nature will be apparent to skilled artisans given the present teaching as a guide.

The shank-receiving opening 50 is configured to receive the shank 13 of a tool 10. This is perhaps best appreciated by comparing FIG. 3A to FIGS. 3B and 3C. The shank-receiving opening 50 opens through the workpiece-facing wall 24F of the holder plate 22, and extends into the body of the plate 22. Preferably, this opening 50 extends entirely between, and opens through both, the front 24F and rear 24R faces of the holder plate 22. Accordingly, when the rear face 24R of the holder plate 22 is attached to the backing plate 40, the backing plate 40 defines the closed rear end of the shank-receiving opening 50. Thus, when a tool 10 is operatively positioned within the shank-receiving opening 50, the shank 13 of the tool 10 is preferably bottomed-out in this opening 50, such that the butt end (i.e., the non-tip end) of the tool 10 is in direct contact with the closed rear end (e.g., the backing plate 40) of the shank-receiving bore 50.

Tools commonly have cylindrical shanks, which are circular in cross-section. As a consequence, the shank-receiving opening 50 in the holder plate 22 will commonly be an elongated bore having a cylindrical configuration, characterized by a circular cross-section. In such cases, the inner diameter 50D (depicted in FIG. 3C) of this bore 50 is selected to correspond to (i.e., to be substantially the same as, or slightly greater than) the outer diameter of the shank 13 of the desired tool 10.

The shank-receiving opening 50 can alternatively be configured to accommodate a shank having a non-circular cross section. In such cases, the shank-receiving opening 50 in the holder plate 22 has inner dimensions that are selected to correspond to (i.e., to be substantially the same as, or slightly greater than) outer dimensions of the non-circular shank. For example, FIG. 11 illustrates a tool 10 and a shank-receiving opening 50 that both are rectangular in cross section.

The second opening (or "mount opening") 60 in the holder plate 22 is adapted to receive a ball-lock insert assembly 25. This is perhaps best appreciated with reference to FIG. 3A relative to FIGS. 3B and 3C. The mount opening 60 opens through the workpiece-facing wall 24F of the holder plate. Preferably, this opening 60 extends entirely between, and opens through both, the front 24F and rear 24R faces of the holder plate 22. In certain embodiments (see FIGS. 5–7), the body of the ball-lock insert assembly 25 has a cylindrical exterior configuration. Thus, the mount opening 60 may be an elongated cylindrical bore. In such cases, the inner diameter 60D (depicted in FIG. 3C) of the mount opening 60 is selected to correspond to (i.e., to be substantially the same as, or slightly greater than) the outer diameter of the insert 25.

It is advantageous if the mount opening 60 can be provided in the form of a cylindrical bore, having a circular cross section. This allows the mount opening 60 to be formed by a simple drilling procedure. Since the openings in the holder plate may be machined by the customer, it is preferable if each mount opening 60 can be formed by basic machining procedures, such as drilling. This can be accomplished by providing the ball-lock insert assembly 25 in the form of a cylinder.

Preferably, the mount opening 60 can be formed so that its axis is perpendicular to the front 24F and/or rear 24R faces of the holder plate 22. This allows the mount opening 60 to be formed by drilling perpendicularly into either the front 24F or rear 24R face of the holder plate 22. In comparison, it can be appreciated that the manufacturing process is less than ideal for prior art retainer blocks wherein the bore for housing the spring-biased ball is drilled at an angle into the rigid, mechanically-durable block.

It is particularly advantageous if the mount opening 60 can be provided in the form of a cylindrical bore extending entirely between, and opening through both, the front 24F and rear 24R faces of the holder plate 22. This in particular facilitates convenient manufacturing of the holder plate 22, as the mount bore 60 can be drilled through the holder plate 22 from either side 24F of 24R of the plate 22. This is also advantageous in that when the mount opening 60 extends entirely through the holder plate 22, it is not necessary to precisely control the depth to which this opening 60 is drilled. In comparison, a ball-lock insert adapted for mounting in a blind opening would require precise control over the depth of the blind opening to assure proper alignment of the tapered recess on the shank of the tool 10 with the engagement member 27 of the ball-lock insert assembly 25. Having to form in the holder plate 22 a blind opening of a precise depth would unnecessarily complicate the process of manufacturing the holder plate 22, which manufacturing may be performed by the customer in certain embodiments of the present invention.

In particularly preferred embodiments, the shank-receiving openings 50 and the mount openings 60 in the holder plate 22 both are cylindrical bores that extend entirely between the front 24F and rear 24R faces of the holder plate 22 and that have their axes oriented perpendicular to the front face 24F and/or the rear face 24R of the holder plate 22. This affords particularly convenient manufacturing of the holder plate 22. As noted above, parallel cylindrical bores 50, 60 can be drilled in the hard, mechanically-durable holder plate 22 much more easily than non-parallel bores. Moreover, when the bores 50, 60 extend entirely through the holder plate 22, it is not necessary to precisely control the depth of the bores.

Several figures of the present disclosure illustrate embodiments wherein the shank-receiving opening 50 and the mount opening 60 both are cylindrical. In these embodiments, the shank-receiving opening 50 and mount opening 60 preferably intersect each another. That is, these openings 50, 60 are preferably open to each other along one side, to a partial circumferential extent. The "line" or "width" of intersection of the shank-receiving opening 50 and the mount opening 60 is denoted in FIG. 3C by the reference character "I". These openings preferably intersect to an extent less than the diameter of the smaller of the two openings 50, 60. That is, the intersection line I of these two openings 50, 60 is preferably shorter than the diameter of the smaller of these two openings 50, 60. In the embodiment of FIG. 3C, for example, the shank-receiving opening 50 has a smaller diameter 50D than the mount opening 60. However, this is by no means a requirement. For example, FIG. 6D depicts one embodiment of the invention wherein the shank-receiving opening 50 has a larger diameter 50D than the mount opening 60. Of course, both openings 50, 60 would have substantially the same inner diameter in cases where the tool shank and the ball-lock insert have substantially the same outer diameter. Thus, it can be appreciated that the intersection line I of these openings 50, 60 is preferably less than the diameter of both openings 50, 60.

The mount opening 60 can alternatively be configured to accommodate a ball-lock insert assembly 25 having a non-cylindrical exterior configuration. In some cases, it may be desirable to provide a ball-lock insert assembly 25 that is generally square (e.g., see FIGS. 11D and 11E) or rectangular in cross section. In such cases, the mount opening 60 preferably has a corresponding non-cylindrical configuration, wherein inner dimensions of the mount opening 60 are selected to correspond to (i.e., to be substantially the same as, or slightly greater than) outer dimensions of the non-cylindrical ball-lock insert assembly 25.

As noted above, the retainer assembly 20 includes a removable ball-lock insert assembly 25. The ball-lock insert 25 comprises a body (the "insert body") that has an axis A and is configured to be received axially within the mount opening 60 in the holder plate 22. In certain embodiments, the insert body has a height (i.e., the distance from the bottom 82 to the top 88 of the insert body) that is substantially equal to the thickness of the holder plate 22. The body of the insert 25 preferably has an exterior dimension that is slightly less than an interior dimension of the mount opening 60, such that the insert 25 can be fitted snugly within the mount opening 60 (e.g., when the insert is in its operative position). In cases where the ball-lock insert 25 has a cylindrical configuration, the exterior diameter of the insert 25 preferably is slightly less than the interior diameter 60D of the mount opening 60.

The body of the ball-lock insert 25 defines an elongated interior recess 25B that is configured to house a resiliently-biased engagement member 27. This elongated interior recess 25B defines a path of travel for the engagement member 27. As shown in FIG. 5C, the interior recess 25B may be an elongated cylindrical bore, although this is not a requirement. The interior recess 25B (i.e., its axis, or the path of travel it defines) is oriented at an angle $\alpha$ with respect to the axis A of the insert 25. In certain embodiments, this angle $\alpha$ is between about 10 degrees and about 20 degrees, perhaps optimally about 15 degrees. In other embodiments, it may be desirable to select an angle $\alpha$ for the elongated recess 25B that is outside this range.

It can be appreciated that when the insert 25 is operatively positioned in the mount opening 60 of the holder plate 22, the interior recess 25B of the insert 25 converges with the shank-receiving opening 50 of the holder plate 22. With the insert 25 so positioned, an end region of the interior recess 25B opens through the body (e.g., through a sidewall 25S of the body) of the insert 25 into a midpoint of the shank-receiving opening 50. Further, when the insert 25 is operatively positioned in the mount opening 60, the front face 88 of the insert is a workpiece-facing surface (i.e., a front-facing surface that does not have any part of the holder plate disposed over it).

In the illustrated embodiments, the elongated interior recess 25B of the insert 25 extends from an opening in the rear face 82 of the insert 25 to a seat opening 80 in the side 25S of the insert. This seat opening 80 is preferably configured (i.e., sized and shaped) to allow a portion of the engagement member 27 to extend therethrough, so as to partially obstruct the shank-receiving opening 50 in the holder plate 22. For example, this seat opening 80 can be advantageously provided in the form of a generally tear-shaped aperture, as shown in FIGS. 5B, 6B, and 7B. The major dimension of such an opening 80 is its length (i.e., its dimension along an axis parallel to the axis A of the insert 25), and the minor dimension of such an opening 80 is its width. This opening 80 preferably has a maximum width that is less than the width of the engagement member 27.

The engagement member 27 is configured to fit inside the elongated interior recess 25B of the insert 25. As noted above, a portion of the engagement member 27 is adapted to protrude into the shank-receiving opening 50. Preferably, this portion of the engagement member 27 is provided with a radius. For example, the engagement member 27 may be a sphere (or "ball"), a roller, a bullet-shaped body, or the like. Thus, although the term "ball lock" is used in the present disclosure, the engagement member 27 in the ball-lock insert 25 is not required to be a ball. However, in many cases, the engagement member 27 is a ball, which may be formed of metal or the like. In such cases, the outer diameter of the ball 27 is preferably equal to, or slightly less than, the inner diameter of the elongated interior recess 25B of the insert 25. In one embodiment, a conventional ½ inch diameter ball bearing is used. In this embodiment, the inner diameter of the elongated interior recess 25B should be at least ½ inch, and is more preferably between about 0.5010 inch and about 0.5020 inch.

The ball-lock insert assembly 25 includes a biasing member 21 for urging the engagement member 27 toward the seat opening 80 at the front end of the elongated recess 25B. Any desired biasing member 21 can be used, such as a spring, spring clip, or the like. The embodiment of FIG. 1 involves a ball 27 that is resiliently biased by a spring 21. In this embodiment, the spring 21 is positioned between the ball 27 and the backing plate 40 of the retainer assembly 20. A variety of other biasing members and biasing arrangements/systems are known, and can be used without departing from the scope of the invention.

When the ball-lock insert assembly 25 is in its operative position within the mount opening 60 of the holder plate 22, the resiliently-biased engagement member 27 in the elongated interior recess 25B is urged toward a locking position wherein it partially obstructs the shank-receiving opening 50 of the holder plate 50. This partial protrusion of the engagement member 27 into the shank-receiving opening 50 provides a locking mechanism, whereby the engagement member 27 can be effectively wedged between the tapered recess 15 on the tool's shank 13 and the interior surface of the insert's elongated interior recess 25B.

In certain preferred embodiments, the ball-lock insert 25 includes at least one catch surface configured for securing the insert 25 within the mount opening 60 of the holder plate 22. As noted above, the mount opening 60 preferably opens through both walls 24F, 24R of the holder plate 22. Thus, it will typically be desirable to secure the insert 25 in the mount opening 60 during operation. Toward this end, the invention provides inserts having a number of different types of catch surfaces.

In certain embodiments, the catch surface 84 on the insert body is defined by a shoulder integral to the insert body. As shown in FIGS. 1, 3A, 5, and 11C, this shoulder may be defined by an oversized base 83 of the insert body, which oversized base has a greater outer diameter than the rest of the insert 25. The mount opening 60 in this embodiment is formed so as to have a corresponding interior configuration with an enlarged end region 63. Preferably, the enlarged end region 63 of the mount opening 60 has an inner diameter that is substantially the same as, or slightly greater than, the outer diameter of the oversized base 83 of the insert 25.

In another embodiment, the catch surface on the insert body is provided by a slot 87 that is adapted to receive a retaining ring 187. Embodiments of this nature are shown in FIGS. 6 and 9. In still other embodiments, the insert body has a reduced-diameter front end portion 86, such that a shoulder is defined by the full-diameter base portion of the insert body. As is perhaps best appreciated with reference to FIG. 7, this shoulder defines a catch surface 85 that is configured for securing the insert body within the mount opening 60.

When the ball-lock insert assembly 25 is operatively positioned in the mount opening 60, the front face 88 of the insert 25 preferably lies generally flush with the front face 24F of the holder plate 22, although this is by no means a requirement. In certain embodiments, when the insert 25 is located in the mount opening 60, the front 88 and rear 82 faces of the insert 25 lie flush with the front 24F and rear 24R faces of the holder plate 22, respectively. This is perhaps best understood with reference to FIG. 3. In other embodiments, the front face 88 of the operatively-positioned insert 25 is offset below or above the workpiece-facing surface 24F of the holder plate 22. In such embodiments, it is preferable that the front face 88 of the insert 25 be readily accessible from the front of the holder plate 22. For example, a major portion of the insert's front face 88 is preferably exposed at the front of the holder plate 22. In other words, substantially the entire front face 88 of the insert is preferably a workpiece-facing surface, which is not concealed beneath any portion of the holder plate 22.

The body of the insert 25 preferably defines at least one access opening 29 into which a removal tool 30 can be inserted. Preferably, the access opening 29 has an elongated length extending through the insert body and into the elongated interior recess 25B of the insert body. That is, the access opening 29 preferably extends between the front face 88 of the insert 25 and the interior recess 25B of the insert body. The front-most length of the access opening 29 is preferably defined by the insert body. In fact, the entire length of the access opening 29 is preferably bounded on all sides by the body of the insert body. This is preferable as it allows customers to machine mount openings 60 without also having to form access openings in the holder plate 22.

FIGS. 5A–5C depict one ball-lock insert assembly 25 that can be used in connection with the present invention. The body of the insert 25 defines an elongated interior recess 25B, has a tear-shaped seat opening 80, and generally has the same features as have been described. The insert 25 in this embodiment has an oversized base 83 that provides a catch surface 84 to facilitate positioning the insert 25 within the mount opening 60 of the holder plate 22. This oversized base 83 has a greater outer diameter than the rest of the insert 25. The mount opening 60 in this embodiment has a corresponding interior configuration with an enlarged end region 63. This enlarged end region 63 has an inner diameter that is substantially the same as, or slightly greater than, the outer diameter of the oversized base 83 of the insert 25. As is perhaps best appreciated with reference to FIGS. 3A and 3B, when an insert 25 of this nature is placed into the opening 60 in the rear face 24R of the holder plate 22, the insert 25 can only be advanced to the point where its front face 88 is flush with the front face 24F of the holder plate 22. At this point, the catch surface 84 defined by the shoulder of the oversized base 83 engages a confronting surface 64 of the holder plate 22, which confronting surface 64 bounds the enlarged end region 63 of the mount opening 60. The rear face 82 of the thus positioned insert 25 is then flush with the rear face 24R of the holder plate 22. As shown in FIG. 3A, the insert 25 can be secured in this position by attaching the rear face 24R of the holder plate 22 to the backing plate 40, as described above.

FIGS. 6A–6C depict another ball-lock insert assembly 25 of the invention. Rather than having an enlarged base region to facilitate correct positioning of the insert), this particular insert 25 has a catch surface provided by a narrow circumferentially-extending groove (or "slot") 87. This slot 87 is adapted to receive a small retaining ring 187 having an outer diameter that is greater than the maximum outer diameter of the insert 25. This retaining ring 187 may take the form of a generally "C"-shaped clip that can be positioned in the slot 87 on the insert 25. As seen in FIG. 6D, the mount opening 60 in this embodiment has a corresponding interior configuration with an enlarged end region 63. This enlarged end region 63 of the mount opening 60 has an inner diameter that is substantially the same as, or slightly greater than, the outer diameter of the retaining ring 187. Thus, when the insert 25 is placed into the mount opening 60 through the rear face 24R of the holder plate 22, the insert 25 can only be advanced to the point where its front face 88 is flush with the front face 24F of the holder plate 22. At this point, the retaining ring 187 engages a confronting surface 64 of the holder plate 22, which confronting surface 64 bounds the enlarged region 63 of the mount opening 60. The rear face 82 of the thus positioned insert 25 is then flush with the rear face 24R of the holder plate 22, and can be secured in this position by attaching the rear face 24R of the holder plate 22 to the backing plate 40.

FIGS. 7A–7C depict another ball-lock insert assembly 25 that can be used in connection with the present invention. The body of the insert in this embodiment has a reduced-diameter front end portion 86 that defines a catch surface 85 to facilitate proper positioning of the insert 25 within the mount opening 60. As seen in FIG. 7D, at least one insert-retaining fastener 90 is anchored in the holder plate 22 adjacent the mount opening 60. An enlarged head portion 91 of the fastener 90 engages the catch surface 85 of the insert 25. Thus, engagement of the catch surface 85 and the fastener 90 keeps the insert 25 retained in its intended position. In this embodiment, it can be appreciated that the front face 88 of the operatively-positioned insert 25 is flush with the front face 24F of the holder plate 22, while the rear face 82 of the insert 25 is flush with the rear face 24R of the holder plate 22. As noted above, the insert 25 can be secured in this position by attaching the rear face 24R of the holder plate 22 against the backing plate 40, so as to trap the insert 25 between the enlarged head portion 91 of the fastener 90 and the backing plate 40.

Figure 8:
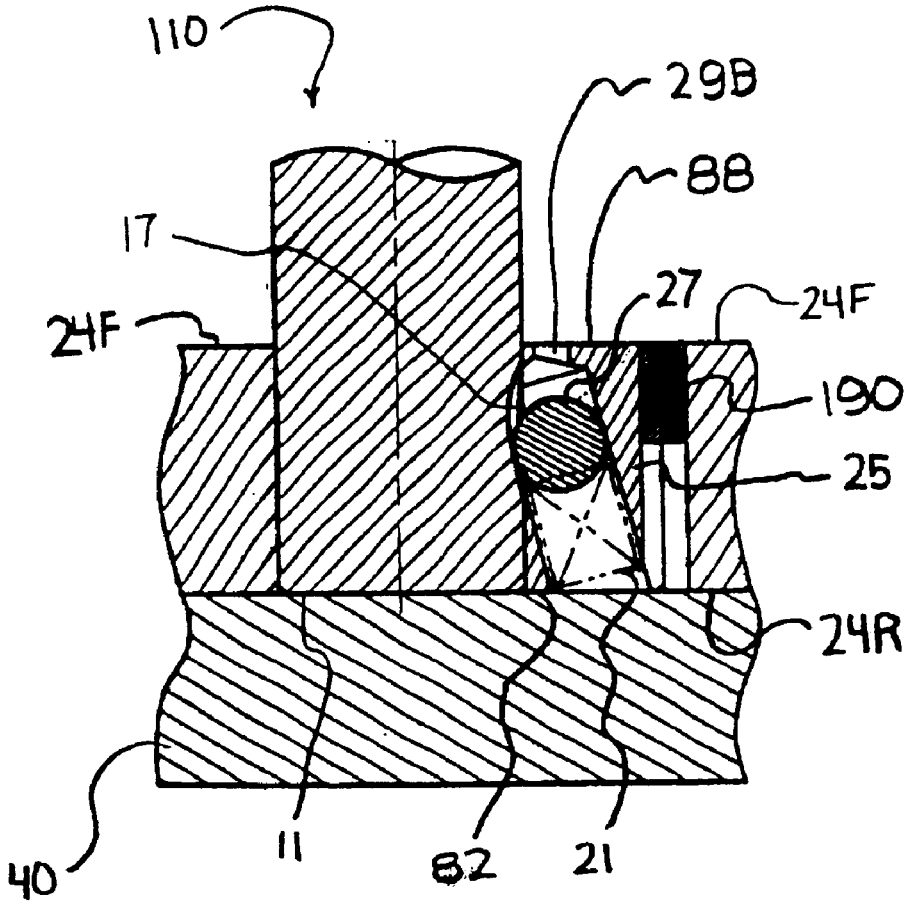
FIG. 8 is a broken-away cross-sectional side view of a ball-lock insert assembly positioned in a holder plate in accordance with another embodiment of the invention.

In embodiments like that depicted in FIG. 7D, any type and number of insert-retaining fasteners 90 can be used. For example, the fastener 90 can be an exteriorly-threaded bolt, screw, or the like anchored in an interiorly-threaded opening formed in the holder plate 22 just beyond the perimeter of the mount opening 60. It may be preferable to position a plurality of fasteners 90 about the perimeter of the mount opening 60. Good results have been achieved, for example, using two diametrically-opposed bolts 90. In the embodiment of FIG. 7D, the fastener 90 is provided with a countersink such that the head portion 91 of the fastener 90 is recessed just below the front face 24F of the holder plate 22. It may also be desirable to use one or more dowel pins 190, alone or in combination with other fasteners, to locate the insert 25 in the mount opening 60. One embodiment of this nature is illustrated in FIG. 8. Given the present teaching as a guide, skilled artisans would recognize a number of other fastening arrangements that could be used.

As noted above, the front face 88 of the insert 25 preferably defines one or more access openings 29 that facilitate unlocking the ball-lock device and removing the tool 10. The insert 25 can have a number of different access opening configurations. FIG. 1 illustrates an embodiment wherein the insert 25 is provided with two access openings 29A, 29B. FIGS. 3A, 6D, 7D, 8, and 9A–9B illustrate embodiments wherein only a single access opening 29 is provided. Generally speaking, each access opening 29 will be either an angled opening 29A or a vertical opening 29B. Angled access openings 29A are particularly advantageous when an oversized punch 210 (see FIG. 9B) is used. As illustrated in FIG. 5C, the angled openings 29A can be oriented at an angle β (see FIG. 5C) with respect to the axis A of the ball-lock insert 25. This angle β may, for example, be on the order of about 25 degrees. Thus, it will be appreciated that the insert 25 can be provided with both a vertical access opening 29B and an angled access opening 29A, as shown in FIG. 1. Alternatively, the insert 25 can be provided with a single access opening 29 of either of the described types (i.e., angled 29A or vertical 29B).

The access openings 29A, 29B can have any desired size and shape. In many cases, each access opening 29 will have an elongated cylindrical configuration, with a circular cross section. An opening of this nature may, for example, have a diameter on the order of about ⅛ inch. Of course, the dimensions of a given access opening 29 can be varied as desired. As noted above, the entire length of the access opening 29 is preferably bounded by the insert 25 alone. For example, the holder plate 22 preferably does not conceal, or form, any partial length of the access opening 29.

Essentially any rigid elongated member can be used as a removal tool with the present ball-lock insert assemblies. For example, a rod or any other elongated member of appropriate size, shape, and rigidity may be used. Preferably, the elongated member has a length with an exterior dimension (e.g., diameter) that is small enough to be inserted into an access opening 29 of the desired insert 25. Conjointly, the length of the elongated member should be great enough to extend from the front face 24F of the insert 25 to the interior recess 25B of the insert 25, to contact the engagement member 27, and to move the engagement 27 out of its locking position with the shank 13 of the tool 10. The elongated member (i.e., the removal tool) is preferably rigid enough to push the engagement member 27 out of its locking position against the opposing force of the biasing member 21.

Figure 10:
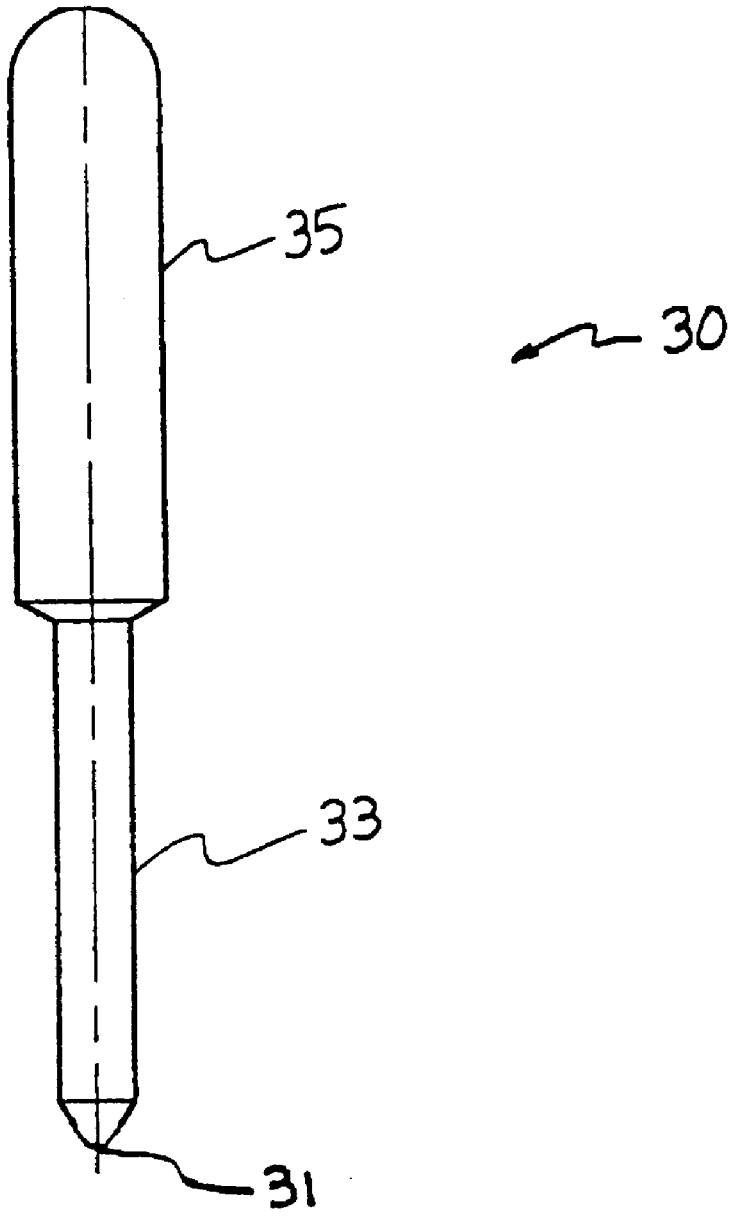
FIG. 10 is side view of a removal tool that is adapted for use with the present invention.
Figure 11A:
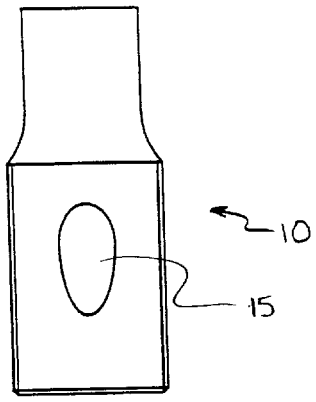
FIG. 11A is a side view of a tool that is adapted for use with the ball-lock insert assembly of the invention.
Figure 11B:
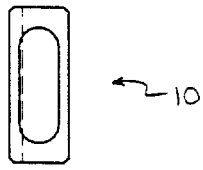
FIG. 11B is a top view of the particular tool of FIG. 11A.
Figure 11D:
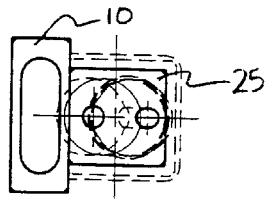
FIG. 11D is a top view of the ball-lock insert assembly of FIG. 11C.
Figure 11C:
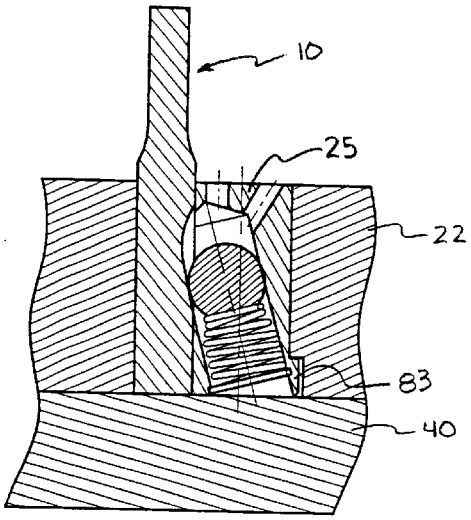
FIG. 11C is a broken-away cross-section side view of a tool held in a holder plate by a ball-lock insert assembly in accordance with one embodiment of the invention.
Figure 11E:
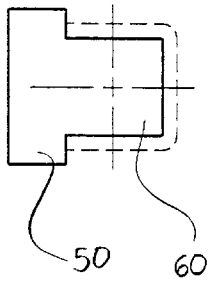
FIG. 11E is a top view of the holder plate of FIG. 11C with the tool and ball-lock insert assembly removed.

The configuration of each access opening 29 in a given insert 25 may be selected to accommodate use of a desired removal tool 30. For example, FIG. 10 illustrates one possible removal tool 30 comprising a handle 35 and an elongated shaft 33 that extends from the handle 35 and defines a distal tip 31. In one embodiment, the handle 35 and shaft 33 of the removal tool 30 are integrally constructed of a single piece of metal (e.g., steel). It will be appreciated that the outer dimension of the shaft 33 is preferably sized to fit within each access opening 29 of the desired ball-lock insert 25. In one embodiment, the shaft 33 of the removal tool 30 has a diameter of about ⅘ inch and each access opening has a diameter of about ⅛ inch. It is to be understood that the present invention is not limited to use with any particular type of removal tool. Rather, any means for moving the engagement member out of engagement with the shank 13 of the tool 10 can be utilized.

The retainer assembly 20 can be attached to a mounting plate (not shown) of a punch press in any desired manner. A number of methods are well known for this attachment to a punch press. For example, it is known to use a series of dowel pins for this purpose. Alternatively, a series of cap screws can be used. Reference is made to U.S. Pat. Nos. 3,103,845 and 5,284,069, the entire contents of each of which are incorporated herein by reference.

It is particularly advantageous to mount the present retainer assembly 20 to a permanent-type punch press. As noted above, permanent-type punch presses characteristically include a plurality of permanently-positioned punch stations, each adapted to perform a given punching operation upon a workpiece that is conveyed sequentially from station to station. Thus, one embodiment of the invention provides a permanent-type punch press to which is mounted a retainer assembly 20 of the nature described herein.

Figure 9A:
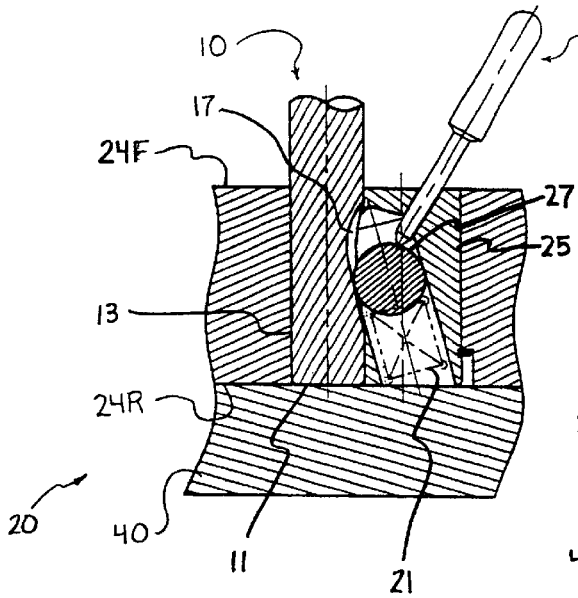
FIG. 9A is a broken-away cross-sectional side view depicting an initial stage of tool removal in accordance with one embodiment of the invention.
Figure 9B:
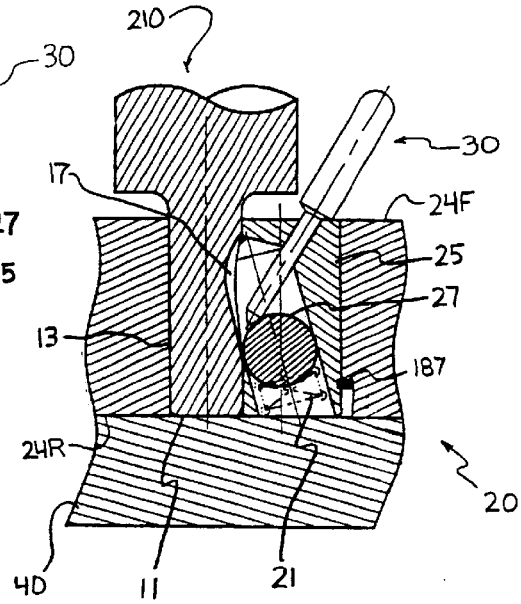
FIG. 9B is a broken-away cross-sectional side view depicting a final stage of tool removal in accordance with another embodiment of the invention.

Use of the present retainer assembly 20 is perhaps best understood with reference to FIGS. 1, 9A, and 9B. With the insert assembly 25 in its operative position within the mount opening 60 of the holder plate 22, the shank 13 of a tool 10 is inserted into the shank-receiving opening 50 of the holder plate 22. Thus, the diameter of the shank 13 may be smaller than that of the ball-lock insert 25 (e.g., in the embodiments of FIGS. 1, 3A, 7D, and 9A–9B) or larger than that of the ball-lock insert 25 (e.g., in the embodiments of FIGS. 6D and 8). The tool 10 may be a "standard" punch (as in the embodiments of FIGS. 1, 3A, 6D, 7D, 8, and 9A), an "oversized" punch (as in the embodiment of FIG. 9B), or any other type of punch, die, or the like.

As the shank 13 of the tool 10 is inserted into the shank-receiving opening 50 in the holder plate 22, the tapered recess 17 on the shank 13 is moved toward alignment with the resiliently-biased engagement member 27. As noted above, the shank 13 of the tool 10 has a depressed surface 15 that defines the tapered recess 17. Thus, when the butt end 11 of the shank 13 contacts the closed rear end (e.g., the backing plate 40) of the shank-receiving opening 50, the resiliently-biased engagement member 27 is urged into this recess 17 and against the depressed surface 15 on the shank 13. The engagement member 27 is thus lockingly engaged with the shank 13 of the tool 10. This constitutes the operative position of the tool, and punching and forming operations are performed while the tool 10 is secured in this position.

As illustrated in FIG. 9A, when it is desired to remove the tool 10, the tip 31 of a removal tool 30 is inserted through an access opening 29 in the ball-lock insert 25 and into engagement with the resiliently-biased engagement member 27. By continuing to advance the removal tool 30, the engagement member 27 is urged away from the shank 13 of the tool 10, thereby compressing the biasing member 21 and moving the engagement member 27 out of engagement with the tapered recess 17 on the shank 13, as illustrated in FIG. 9B. The tool 10 can then be removed from the retainer assembly 20, and discarded, sharpened, or replaced, as desired.

While preferred embodiments of the present invention have been described, it should be understood that a variety of changes, adaptations, and modifications can be made therein without departing from the spirit of the invention and the scope of the appended claims.

What is claimed is:

1. A method of producing a retainer assembly, the method comprising:

a) providing a ball-lock insert assembly comprising an insert body having an axis and an elongated interior recess extending at an angle relative to said axis, the elongated interior recess housing a resiliently-biased engagement member;

b) providing a holder plate having a front, workpiece-facing surface and a rear surface, said front and rear surfaces being generally opposed, the holder plate having a desired thickness; and c) forming in the holder plate first and second elongated openings, said first and second, openings being substantially parallel an intersecting each other, said first elongated opening being configured to receive a shank of a tool, said second elongated opening being an elongated mount opening that is configured to axially receive the insert body, the elongated mount opening being formed so as to extend entirely through the thickness of the holder plate.

2. The method of claim 1 wherein the mount opening is formed in the holder plate by drilling.

3. The method of claim 1 further comprising removably mounting the insert body within the elongated mount opening in the holder plate.

4. The method of claim 3 further comprising attaching a backing plate to the rear face of the holder plate.

5. The method of claim 1 further comprising forming in the holder plate a further elongated mount opening that extends entirely through the thickness of the holder plate, said further mount opening being configured to receive a second ball-lock insert assembly of the nature described in step a) of claim 29.

6. The method of claim 1 further comprising mounting the insert body in the elongated mount opening such that a front face of the insert body is a front, workpiece-facing surface that does not have any part of the holder plate disposed over it.

7. The method of claim 1 wherein the insert body has a height that is substantially equal to the thickness of the holder plate.

8. The method of claim 1 further comprising mounting the insert body within the elongated mount opening in an operative position wherein a front face of the insert body is substantially flush with the front face of the holder plate.

9. The method of claim 1 wherein said first and second openings are each formed so as to extend entirely through the thickness of the holder plate.

10. The method of claim 1 wherein said first and second openings are each formed so as to be substantially perpendicular to the front and rear faces of the holder plate.

11. The method of claim 1 wherein the insert body defines an elongated access opening into which a removal tool can be inserted, wherein the access opening is defined by the insert body and has an elongated length that extends through the insert body and into said elongated interior recess.

12. The method of claim 11 wherein the front-most length of the access opening is bounded by the insert body.

13. The method of claim 11 wherein substantially the entire length of the access opening is bounded on all sides by the insert body.

14. The method of claim 1 the insert body defines said elongated interior recess, and wherein said elongated interior recess extends from an opening in a rear face of the insert body to an opening in a side of the insert body.

15. The method of claim 1 wherein the insert body defines said elongated interior recess, and wherein said elongated interior recess is a cylindrical bore.

16. The method of claim 1 wherein the elongated interior recess of the insert body extends at an angle of between about 10 degrees and about 20 degrees relative to said axis of the insert body.

17. The method of claim 1 wherein the insert body has an exterior dimension that is slightly less than an interior dimension of the mount opening, such that the insert body can be snuggly fitted within the mount opening.

18. The method of claim 17 wherein the insert body has a cylindrical outer configuration, wherein the mount opening has a cylindrical interior configuration, and wherein the insert body has an exterior diameter that is slightly less than the interior diameter of the mount opening.

19. The method of claim 1 wherein the insert body has a catch surface defined by a shoulder integral to the insert body.

20. A retainer assembly for a punch press, the retainer assembly comprising a holder plate of a desired thickness, the holder plate having therein formed first and second elongated openings each extending entirely through the thickness of the holder plate, said first and second openings being substantially parallel and intersecting each other, said first opening being configured to receive the shank of a tool, the retainer assembly including a removable ball-lock insert assembly comprising an insert body, the insert body having an axis and an elongated interior recess extending at an angle relative to said axis, the elongated interior recess housing a resiliently-biased engagement member, the insert body being configured to be received axially within said second opening in an operative position wherein one end region of the elongated interior recess opens through a sidewall of the insert body into said first opening in the holder plate.

21. The retainer assembly of claim 20 wherein the insert body has a height that is substantially equal to the thickness of the holder plate.

22. The retainer assembly of claim 20 wherein the holder plate has generally-opposed front and rear faces, the insert body having a front face that is substantially flush with the front face of the holder plate when the insert body is in its operative position.

23. The retainer assembly of claim 20 wherein a removal tool can be inserted into an elongated access opening that extends through the insert body and into the elongated interior recess of the insert body.

24. The retainer assembly of claim 23 wherein the frontmost length of the elongated access opening is bounded by the insert body.

25. The retainer assembly of claim 24 wherein substantially the entire length of the elongated access opening is bounded on all sides by the insert body.

26. The retainer assembly of claim 20 wherein the insert body has a cylindrical outer configuration having a circular cross section.

27. The retainer assembly of claim 26 wherein said second opening in the holder plate has a cylindrical interior configuration.

28. The retainer assembly of claim 27 wherein the insert body has an exterior diameter that is slightly less than an interior diameter of said second bore in the holder plate, such that the insert body is fitted snugly within said second bore when placed in said operative position.

29. The retainer assembly of claim 20 wherein the engagement member has a width greater than a width of intersection of said first and second bores in the holder plate.

30. The retainer assembly of claim 29 wherein said engagement member housed in said elongated interior recess is resiliently biased toward a locking position wherein a portion of the engagement member partially obstructs said first bore in the holder plate when the insert body is placed in said operative position.

31. The retainer assembly of claim 30 wherein the engagement member is a ball.

32. The retainer assembly of claim 31 wherein the engagement member is resiliently biased toward said locking position by a spring in said elongated interior recess.

33. A retainer assembly for a punch press, the retainer assembly comprising a holder plate having a first workpiece-facing surface and second rear surface, the holder plate having a desired thickness, said first and second surfaces being generally opposed, the holder plate having therein formed first and second elongated openings, said first and second openings being substantially parallel and intersecting each other, said first opening being configured to receive the shank of a tool, said second opening extending entirely through the thickness of the holder plate, the retainer assembly including a ball-lock insert assembly comprising an insert body having a height that is substantially equal to the thickness of the holder plate, the insert body having an axis and an elongated interior recess extending at an angle relative to said axis, the elongated interior recess housing a resiliently-biased engagement member, the insert body being removably mounted within said second opening in an operative position wherein one end region of the elongated interior recess opens through a sidewall of the insert body into said first opening in the holder plate.

34. The retainer assembly of claim 33 wherein the insert body has a front face that is substantially flush with the front face of the holder plate.

35. The retainer assembly of claim 33 wherein an elongated access opening extends between a front face of the insert body and substantially the entire length of the elongated access opening is bounded on all sides by the insert body.

* * * * *

US006755103C1

(12) EX PARTE REEXAMINATION CERTIFICATE (5696th)

United States Patent
Morehead

(10) Number: US 6,755,103 C1
(45) Certificate Issued: Mar. 6, 2007

(54) BALL-LOCK INSERT ASSEMBLIES

(75) Inventor: John H. Morehead, White Bear Lake, MN (US)

(73) Assignee: Wilson Tool International, Inc., White Bear Lake, MN (US)

Reexamination Request:
No. 90/007,251, Oct. 12, 2004

Reexamination Certificate for:

| | |
|---|---|
| Patent No.: | **6,755,103** |
| Issued: | **Jun. 29, 2004** |
| Appl. No.: | **10/071,888** |
| Filed: | **Feb. 8, 2002** |

(51) Int. Cl.
*B62D 1/00* (2006.01)

(52) U.S. Cl. ..... 83/13; 83/140; 83/698.31; 83/698.91

(58) Field of Classification Search ..... 83/13, 83/140, 698.37, 698.91, 698.31, 686–689; 279/77, 79, 22, 23.1, 30; 403/326, 327, 328, 403/329; 74/527
See application file for complete search history.

(56) References Cited

U.S. PATENT DOCUMENTS

| | | | | |
|---|---|---|---|---|
| 239,958 A | | 4/1881 | Inman | 403/257 |
| 1,393,040 A | | 10/1921 | Richard et al. | 279/30 |
| 1,621,811 A | | 3/1927 | Otis et al. | 279/30 |
| 1,860,998 A | | 5/1932 | Morehead | 279/76 |
| 1,904,951 A | | 4/1933 | Peterson | 83/140 |
| 1,910,275 A | | 5/1933 | Alden | 279/77 |
| 1,910,296 A | | 5/1933 | King | 279/77 |
| 1,938,440 A | | 12/1933 | Richard | 279/30 |
| 2,089,166 A | | 8/1937 | Reichhardt | 279/30 |
| 2,160,676 A | | 5/1939 | Richard | 83/140 |
| 2,166,559 A | | 7/1939 | Richard | 279/30 |
| 2,217,560 A | | 10/1940 | Michon | 83/684 |
| 2,580,930 A | | 1/1952 | Kost | 279/30 |
| 2,662,773 A | | 12/1953 | Parsons | 279/30 |
| 2,707,830 A | | 5/1955 | McColl | 30/336 |
| 3,106,122 A | | 10/1963 | Newcomb | 83/698.31 |
| 3,120,601 A | * | 2/1964 | Berlin et al. | 219/69.15 |
| 3,176,998 A | | 4/1965 | Parker | 279/76 |
| 3,245,694 A | | 4/1966 | Parker | 279/30 |
| 3,548,700 A | | 12/1970 | Herzog | 83/698.91 |
| 3,563,124 A | | 2/1971 | Gargrave | 83/698.31 |
| 3,589,226 A | | 6/1971 | Shadowens, Jr. | 83/143 |
| 3,707,303 A | | 12/1972 | Petri | 403/328 |
| 3,721,154 A | * | 3/1973 | Leibinger et al. | 83/698.71 |
| 3,901,475 A | | 8/1975 | Dreibelbis | 251/360 |
| 3,932,904 A | | 1/1976 | Nilsson | 279/145 |
| 3,934,591 A | | 1/1976 | Gleason | 606/132 |

(Continued)

OTHER PUBLICATIONS

Exhibit A, Exhibit A is a three page excerpt from a brochure from Porter Precision Products, Co. describing Bol–Lok Retainers that was published prior to the invention of this application.
Exhibit B, Exhibit B is a five page excerpt from a describing several types of punch retainers that was published prior to the invention of this application.
Exhibit C, Exhibit C is a five page excerpt from a brochure from Dayton corporation describing several punch retainers that was published prior to the invention of this application.
Exhibit E, Exhibit E is a five page excerpt from a Dayton Corporation brochure describing several punch retainers that was published prior to the invention of this application.
Exhibit F, Exhibit F is a three page excerpt from a 1994/1995 JP&T catalog describing several punch retainers.

*Primary Examiner*—Matthew C. Graham

(57) ABSTRACT

The invention provides a ball-lock insert assembly adapted to be mounted axially in a mount opening formed in a holder plate having a desired thickness. The ball-lock insert assembly comprises an insert body having an axis and an elongated interior recess extending at an angle relative to this axis. The elongated interior recess is configured to house a resiliently-biased engagement member. The invention also provides retainer assemblies that include ball-lock assemblies, as well as methods of producing retainer assemblies, which methods include providing ball-lock assemblies.

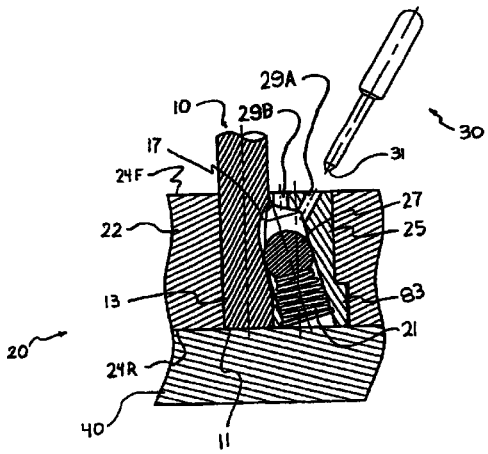

U.S. PATENT DOCUMENTS 4,096,776 A 6/1978 Laucke ..... 83/698.91
4,174,648 A 11/1979 Wallis ..... 83/698.31
4,218,794 A 8/1980 Seidel et al. ..... 30/158
4,339,976 A 7/1982 Wallis ..... 83/684
4,377,100 A 3/1983 Wallis ..... 83/698.31
4,558,620 A 12/1985 Wallis ..... 83/699.31
4,601,477 A 7/1986 Barrett et al. ..... 279/30
4,726,270 A 2/1988 Lucas ..... 83/13
4,843,931 A 7/1989 Whister ..... 83/138
4,947,718 A 8/1990 Whistler ..... 83/138
4,954,006 A 9/1990 Suzuki et al. ..... 403/135
4,995,755 A 2/1991 Hyodo et al. ..... 403/133
5,029,505 A * 7/1991 Holliday ..... 83/652
5,038,599 A 8/1991 Wellman ..... 72/482.91
5,048,993 A 9/1991 Yoon ..... 403/24
5,181,438 A 1/1993 Wellman ..... 76/107.1
5,197,368 A * 3/1993 Meyer et al. ..... 83/698.31
5,284,069 A 2/1994 Wellman ..... 76/107.1
5,301,580 A 4/1994 Rosene ..... 83/136
5,307,720 A 5/1994 Meyer et al. ..... 83/698.11
5,357,835 A 10/1994 Moellering ..... 83/698.31
5,357,836 A 10/1994 Stromberg et al. ..... 83/698.31
5,410,932 A 5/1995 Moellering ..... 83/698.31
5,562,357 A 10/1996 Sandell ..... 403/122
5,651,647 A 7/1997 Ray ..... 279/14
5,839,183 A 11/1998 Powlett ..... 29/464
5,878,642 A 3/1999 Roseliep ..... 83/690
5,881,625 A 3/1999 Wellman ..... 83/563
6,158,928 A 12/2000 Hecht ..... 407/102
6,182,545 B1 * 2/2001 Janek, Jr. ..... 83/13
6,324,768 B1 12/2001 Wellman ..... 33/501.05
6,679,147 B1 * 1/2004 Chaulklin ..... 93/698.91
7,051,635 B2 * 5/2006 Morehead ..... 83/698.31

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THE PARAGRAPHS OF THE SPECIFICATION AFFECTED BY AMENDMENT ARE PRINTED HEREIN.

Column 6, lines 47–61:

The second opening (or "mount opening") 60 in the holder plate 22 is adapted to receive a ball-lock insert assembly 25. This is perhaps best appreciated with reference to FIG. 3A relative to FIGS. 3B and 3C. The mount opening 60 opens through the workpiece-facing wall 24F of the holder plate. Preferably, this opening 60 extends entirely between, and opens through both, the front 24F and rear 24R faces of the holder plate 22. In certain embodiments (see FIGS. 5–7), the body of the ball-lock insert assembly 25 has a *generally* cylindrical exterior configuration. Thus, the mount opening 60 may be an elongated cylindrical bore. In such cases, the inner diameter 60D (depicted in FIG. 3C) of the mount opening 60 is selected to correspond to (i.e., to be substantially the same as, or slightly greater than) the outer diameter of the insert 25.

Column 6, line 62 to column 7, line 4:

It is advantageous if the mount opening 60 can be provided in the form of a cylindrical bore, having a circular cross section. This allows the mount opening 60 to be formed by a simple drilling procedure. Since the openings in the holder plate may be machined by the customer, it is preferable if each mount opening 60 can be formed by basic machining procedures, such as drilling. This can be accomplished by providing the ball-lock insert assembly 25 in the form of a cylinder. *As shown in FIGS. 5A–5C, 6A–6C, and 7A–7C, such an insert can have a generally circular cross section.*

Column 7, line 47 to column 8, line 4:

Several figures of the present disclosure illustrate embodiments wherein the shank-receiving opening 50 and the mount opening 60 both are cylindrical. In these embodiments, the shank-receiving opening 50 and mount opening 60 preferably intersect each another. That is, these openings 50, 60 are preferably open to each other along one side, to a partial circumferential extent. The "line" or "width" of intersection of the shank-receiving opening 50 and the mount opening 60 is denoted in FIG. 3C by the reference character "I". *The engagement member in some embodiments has a width greater than the width of intersection of the first and second openings 50, 60.* These openings preferably intersect to an extent less than the diameter of the smaller of the two openings 50, 60. That is, the intersection line I of these two openings 50, 60 is preferably shorter than the diameter of the smaller of these two openings 50, 60. In the embodiment of FIG. 3C, for example, the shank-receiving opening 50 has a smaller diameter 50D than the mount opening 60. However, this is by no means a requirement. For example, FIG. 6D depicts one embodiment of the invention wherein the shank-receiving opening 50 has a larger diameter 50D than the mount opening 60. Of course, both openings 50, 60 would have substantially the same inner diameter in cases where the tool shank and the ball-lock insert have substantially the same outer diameter. Thus, it can be appreciated that the intersection line I of these openings 50, 60 is preferably less than the diameter of both openings 50, 60.

AS A RESULT OF REEXAMINATION, IT HAS BEEN DETERMINED THAT:

Claims 14, 17 and 26 are cancelled.

Claims 1, 4, 5, 8, 10, 12, 15, 18–20, 24, 25, 27–30 and 33–35 are determined to be patentable as amended.

Claims 2, 3, 6, 7, 9, 11, 13, 16, 21–23, 31, and 32, dependent on an amended claim, are determined to be patentable.

New claims 36–39 are added and determined to be patentable.

1. A method of producing a retainer assembly, the method comprising:

a) providing a ball-lock insert assembly comprising an insert body having an axis and an elongated interior recess extending at an angle relative to said axis, the elongated interior recess housing a resiliently-biased engagement member, *wherein the insert body defines said elongated interior recess, and wherein said elongated interior recess extends from an opening in a rear face of the insert body to an opening in a side of the insert body*;

b) providing a holder plate having a front, workpiece-facing surface and a rear surface, said front and rear surfaces being generally opposed, the holder plate having a desired thickness; and c) forming in the holder plate first and second elongated openings, said first and second, openings being substantially parallel [an] *and* intersecting each other, said first elongated opening being configured to receive a shank of a tool, said second elongated opening being an elongated mount opening that is configured to axially receive the insert body, the elongated mount opening being formed so as to extend entirely through the thickness of the holder plate.

4. The method of claim 3 further comprising attaching a backing plate to the rear [face] *surface* of the holder plate.

5. The method of claim 1 further comprising forming in the holder plate a further elongated mount opening that extends entirely through the thickness of the holder plate, said further mount opening being configured to receive a second ball-lock insert assembly of the nature described in step a) of claim [29] *1*.

8. The method of claim 1 further comprising mounting the insert body within the elongated mount opening in an operative position wherein a front face of the insert body is substantially flush with the front [face], *workpiece-facing surface* of the holder plate.

10. The method of claim 1 wherein said first and second openings are each formed so as to be substantially perpendicular to the front and rear [faces] *surfaces* of the holder plate.

12. The method of claim 11 wherein [the] *a* front-most length of the access opening is bounded by the insert body.

15. The method of claim 1 wherein the insert body defines said elongated interior recess, and wherein said elongated interior recess is a cylindrical bore, *and wherein the resiliently-biased engagement member is a ball.*

18. [The] *A* method of [claim 17] *producing a retainer assembly, the method comprising:*

*a) providing a ball-lock insert assembly comprising an insert body having an axis and an elongated interior recess extending at an angle relative to said axis, the elongated interior recess housing a resiliently-biased engagement member;*

*b) providing a holder plate having a front, workpiece-facing surface and a rear surface, said front and rear surfaces being generally opposed, the holder plate having a desired thickness; and*

*c) forming in the holder plate first and second elongated openings, said first and second, openings being substantially parallel and intersecting each other, said first elongated opening being configured to receive a shank of a tool, said second elongated opening being an elongated mount opening that is configured to axially receive the insert body, the elongated mount opening being formed so as to extend entirely through the thickness of the holder plate;*

*wherein the insert body has an exterior dimension enabling it to be snuggly fitted within the mount opening,* wherein the insert body has a *generally* cylindrical outer configuration, wherein the mount opening has a cylindrical interior configuration, and wherein the insert body has an exterior diameter that is slightly less than [the] *an* interior diameter of the mount opening.

19. The method of claim [1] *18* wherein the insert body has a catch surface *configured for securing the insert body within the mount opening of the holder plate, the catch surface being* defined by a shoulder integral to the insert body, *the shoulder being defined by an oversized base of the insert body, said oversized base having a greater outer diameter than the rest of the insert body.*

20. A retainer assembly for a punch press, the retainer assembly comprising a holder plate of a desired thickness, the holder plate having therein formed first and second elongated openings each extending entirely through the thickness of the holder plate, said first and second openings being substantially parallel and intersecting each other, said first opening being configured to receive the shank of a tool, the retainer assembly including a removable ball-lock insert assembly comprising an insert body, the insert body having an axis and an elongated interior recess extending at an angle relative to said axis, the elongated interior recess housing a resiliently-biased engagement member, the insert body being configured to be received axially within said second opening in an operative position wherein one end region of the elongated interior recess opens through a sidewall of the insert body into said first opening in the holder plate, *wherein the insert body has a generally cylindrical outer configuration having a generally circular cross section.*

24. The retainer assembly of claim 23 wherein [the] *a* front-most length of the elongated access opening is bounded by the insert body.

25. The retainer assembly of claim 24 wherein substantially [the] *an* entire length of the elongated access opening is bounded on all sides by the insert body.

27. The retainer assembly of claim [26] *20* wherein said second opening in the holder plate has a cylindrical interior configuration.

28. The retainer assembly of claim 27 wherein the insert body has an exterior diameter that is slightly less than an interior diameter of said second [bore] *opening* in the holder plate, such that the insert body is fitted snugly within said second [bore] *opening* when placed in said operative position.

29. [The retainer assembly of claim 20] *A retainer assembly for a punch press, the retainer assembly comprising a holder plate of a desired thickness, the holder plate having therein formed first and second elongated openings each extending entirely through the thickness of the holder plate, said first and second openings being substantially parallel and intersecting each other, said first opening being configured to receive the shank of a tool, the retainer assembly including a removable ball-lock insert assembly comprising an insert body, the insert body having an axis and an elongated interior recess extending at an angle relative to said axis, the elongated interior recess housing a resiliently-biased engagement member, the insert body being configured to be received axially within said second opening in an operative position wherein one end region of the elongated interior recess opens through a sidewall of the insert body into said first opening in the holder plate,* wherein the engagement member has a width greater than a width of intersection of said first and second [bores] *openings* in the holder plate.

30. The retainer assembly of claim 29 wherein said engagement member housed in said elongated interior recess is resiliently biased toward a locking position wherein a portion of the engagement member partially obstructs said first [bore] *opening* in the holder plate when the insert body is placed in said operative position.

33. A retainer assembly for a punch press, the retainer assembly comprising a holder plate having a first workpiece-facing surface and second rear surface, the holder plate having a desired thickness, said first and second surfaces being generally opposed, the holder plate having therein formed first and second elongated openings, said first and second openings being substantially parallel and intersecting each other, said first opening being configured to receive the shank of a tool, said second opening extending entirely through the thickness of the holder plate, the retainer assembly including a ball-lock insert assembly comprising an insert body having a height that is substantially equal to the thickness of the holder plate, the insert body having an axis and an elongated interior recess extending at an angle relative to said axis, the elongated interior recess housing a resiliently-biased engagement member, the insert body being removably mounted within said second opening in an operative position wherein one end region of the elongated interior recess opens through a sidewall of the insert body into said first opening in the holder plate, *wherein the insert body has a generally cylindrical outer configuration.*

34. The retainer assembly of claim 33 wherein the insert body has a front face that is substantially flush with the [front face] *workpiece-facing surface* of the holder plate.

35. The retainer assembly of claim 33 wherein an elongated access opening extends [between] *from* a front face of the insert body *to said elongated interior recess,* and *wherein* substantially [the] *an* entire length of the elongated access opening is bounded on all sides by the insert body.

*36. The retainer assembly of claim 33 wherein the insert body in said operative position has a front face a major*

*portion of which is exposed at said front, workpiece-facing surface of the tool holder.*

*37. The retainer assembly of claim 36 wherein substantially the entire front face of the insert body is a workpiece-facing surface that is not concealed beneath any portion of the holder plate.*

*38. The retainer assembly of claim 33 wherein the insert body has a catch surface defined by a shoulder integral to the insert body, the shoulder being defined by an oversized base of the insert body, said oversized base having a greater outer diameter than the rest of the insert body.*

*39. The retainer assembly of claim 33 wherein the insert body has a generally circular cross section.*

* * * * *